US012617009B2

(12) United States Patent
Fujita et al.

(10) Patent No.: US 12,617,009 B2
(45) Date of Patent: May 5, 2026

(54) COLD ROLLING MILL ROLLING CONDITION SETTING METHOD, COLD ROLLING METHOD, STEEL SHEET MANUFACTURING METHOD, COLD ROLLING MILL ROLLING CONDITION SETTING DEVICE, AND COLD ROLLING MILL

(71) Applicant: JFE STEEL CORPORATION, Tokyo (JP)

(72) Inventors: Noriki Fujita, Tokyo (JP); Takuya Kitamura, Tokyo (JP); Tetsuya Arakawa, Tokyo (JP); Yoshiki Ikoma, Tokyo (JP); Takumi Yamada, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 223 days.

(21) Appl. No.: 18/281,496

(22) PCT Filed: Feb. 1, 2022

(86) PCT No.: PCT/JP2022/003791
§ 371 (c)(1),
(2) Date: Sep. 11, 2023

(87) PCT Pub. No.: WO2022/269974
PCT Pub. Date: Dec. 29, 2022

(65) Prior Publication Data

US 2024/0149317 A1 May 9, 2024

(30) Foreign Application Priority Data

Jun. 21, 2021 (JP) ..... 2021-102407

(51) Int. Cl.
*B21B 37/16* (2006.01)
*B21B 3/02* (2006.01)

(52) U.S. Cl.
CPC ..... *B21B 37/165* (2013.01); *B21B 3/02* (2013.01)

(58) Field of Classification Search
CPC ..... B21B 1/28; B21B 3/02; B21B 2001/221; B21B 37/165; B21B 37/28
See application file for complete search history.

(56) References Cited

U.S. PATENT DOCUMENTS 4,463,031 A 7/1984 Someya
8,001,820 B2 8/2011 Pawelski et al.
(Continued)

FOREIGN PATENT DOCUMENTS

CN 102601127 A 7/2012
CN 106660090 A 5/2017
(Continued)

OTHER PUBLICATIONS

CN 112916624A, Wang et al. Jun. 2021.*
(Continued)

*Primary Examiner* — Edward T Tolan
(74) *Attorney, Agent, or Firm* — Oliff PLC

(57) ABSTRACT

A cold rolling mill rolling condition setting method using a prediction model being generated with an explanatory variable being first multi-dimensional data obtained by transforming past rolling performance data including pre-cold rolling data of a roll material on an entry side of the cold rolling mill into multi-dimensional data, and an objective variable being post-cold rolling data of the roll material on a delivery side of the cold rolling mill, the method includes: estimating a post-rolling shape of a roll target material by inputting, to the prediction model, second multi-dimensional
(Continued)

data generated from information including the pre-cold rolling data of the roll target material on the entry side of the cold rolling mill and a target rolling condition of the cold rolling mill; and changing the target rolling condition of the cold rolling mill such that the estimated post-rolling shape of the roll target material satisfies a predetermined condition.

11 Claims, 6 Drawing Sheets

(56) References Cited

U.S. PATENT DOCUMENTS

| | | | |
|---|---|---|---|
| 11,772,142 | B2 | 10/2023 | Fujita et al. |
| 2009/0282884 | A1 | 11/2009 | Pawelski et al. |
| 2022/0072593 | A1 | 3/2022 | Fujita et al. |
| 2022/0126339 | A1 | 4/2022 | Yamazaki |
| 2022/0126342 | A1 | 4/2022 | Sugiyama et al. |
| 2022/0250129 | A1 | 8/2022 | Fujita et al. |

FOREIGN PATENT DOCUMENTS

| | | | | | |
|---|---|---|---|---|---|
| CN | 113172097 | A | | 7/2021 | |
| GB | 2051641 | A | * | 10/1981 | ..... B21B 37/32 |
| JP | H04-5519 | B2 | | 1/1992 | |
| JP | H08-132108 | A | | 5/1996 | |
| JP | 4784320 | B2 | | 10/2011 | |
| JP | 6705519 | B1 | | 6/2020 | |
| JP | 2021-030280 | A | | 3/2021 | |
| KR | 1998-056204 | A | | 9/1998 | |
| TW | 301616 | B | | 4/1997 | |
| WO | 2007025682 | A1 | | 3/2007 | |
| WO | 2016038705 | A1 | | 3/2016 | |
| WO | 2020/148917 | A1 | | 7/2020 | |
| WO | 2020/171096 | A1 | | 8/2020 | |
| WO | 2021/014665 | A1 | | 1/2021 | |

OTHER PUBLICATIONS

Translation CN 112916624A, Wang et al. Jun. 2021.*
CN 108838211B, Liu Sep. 2020.*
JP 2013-099757A, Fujita May 2013.*
CN 108994087A, Xunguo Dec. 2018.*
CN 110125189A, Liang Aug. 2019.*
Sep. 5, 2024 Extended European Search Report issued in European Patent Application No. 22827898.2.
Apr. 5, 2022 International Search Report issued in International Patent Application No. PCT/JP2022/003791.
Sep. 27, 2022 Office Action issued in Taiwanese Patent Application No. 111113748.
Feb. 11 Office Action issued in Chinese Patent Application No. 202280037943.4 (with concise explanation in English).

* cited by examiner

COLD ROLLING MILL ROLLING CONDITION SETTING METHOD, COLD ROLLING METHOD, STEEL SHEET MANUFACTURING METHOD, COLD ROLLING MILL ROLLING CONDITION SETTING DEVICE, AND COLD ROLLING MILL

FIELD

The present invention relates to a cold rolling mill rolling condition setting method, a cold rolling method, a steel sheet manufacturing method, a cold rolling mill rolling condition setting device, and a cold rolling mill.

BACKGROUND

When rolling a roll material such as a cold-rolled thin steel sheet with cold rolling, the rolling is to be typically performed with a stabilized sheet running property of the roll material by obtaining a good shape (or flatness) of the roll material while maintaining favorable thickness accuracy in the longitudinal direction and the width direction of the roll material. On the other hand, for the purpose of suppressing fuel consumption with reduced weight and the like, there is an increasing need for a difficult-to-roll material such as a thin hard material with a high load and a thin pre-rolling sheet thickness. During cold rolling of such a difficult-to-roll material, in order to suppress a rolling load, the difficult-to-roll material is thinned by hot rolling in a preceding step and then sent to a cold rolling step.

In recent years, many of the control factors of the cold rolling mill are automatically controlled by an actuator mounted on the cold rolling mill, leading to a decreased opportunity for an operator to set the control factors of the cold rolling mill. However, at the time of cold rolling of the difficult-to-roll material as described above, the sheet crown (thickness distribution in the width direction) greatly fluctuates in the longitudinal direction in some cases. When the sheet crown has greatly fluctuated in the longitudinal direction, it is often difficult to absorb, with automatic control, fluctuations against correction of roll deflection represented by roll gap, work roll bender, intermediate roll shift, and roll expansion by thermal crown of a cold rolling mill, including a rolling load (and an accompanying calculated forward slip ratio and torque).

Therefore, in such a case, the operator sets a pass schedule and a shape control actuator so as not to hinder productivity while satisfying the facility constraint of the cold rolling mill. For this reason, in recent years, the operating speed of the cold rolling mill and resultant productivity are likely to vary depending on the experience and subjectivity of the operator. In such a background, Patent Literature 1 proposes a method of performing learning of past operating conditions using a neural network and performing mill setup of a cold rolling mill using a result of the learning. In addition, Patent Literature 2 proposes a method of performing feed-forward control of an edge drop using a sheet thickness profile measured on an entry side of a cold rolling mill.

CITATION LIST

Patent Literature

Patent Literature 1: JP 6705519 B
Patent Literature 2: JP 4784320 B

SUMMARY

Technical Problem

However, with the method described in Patent Literature 1, even when the cold rolling mill has an optimum operating condition at the time of mill setup, an occurrence of fluctuation of the sheet crown in the longitudinal direction would lead to a large fluctuation in the shape of the roll material on the delivery side of the cold rolling mill. This leads to a possibility of restriction on the rolling speed due to the shape defects or an occurrence of breakage of the roll material in the worst case. On the other hand, with the method described in Patent Literature 2, the sheet thickness profile includes only one cross section in the longitudinal direction and the edge drop is predicted using a linear regression equation, making it difficult to cope with the case of fluctuation of the sheet crown in the longitudinal direction.

The present invention has been made in view of the above problems, and one object is to provide a cold rolling mill rolling condition setting method and a cold rolling mill rolling condition setting device capable of setting rolling conditions for performing cold rolling with high productivity while ensuring stability of cold rolling even when rolling a difficult-to-roll material with a high load and a small pre-rolling sheet thickness. Another object of the present invention is to provide a cold rolling method and a cold rolling mill capable of performing cold rolling with high productivity while ensuring stability in cold rolling even when a difficult-to-roll material with a high load and a small pre-rolling sheet thickness is rolled with cold rolling. Still another object of the present invention is to provide a steel sheet manufacturing method capable of manufacturing a steel sheet with high yield.

Solution to Problem

To solve the problem and achieve the object, a cold rolling mill rolling condition setting method according to the present invention is the method of setting a target rolling condition of a cold rolling mill when a roll target material is rolled by cold rolling using a prediction model that predicts a post-cold rolling state of the roll target material, the prediction model being generated with an explanatory variable and an objective variable, the explanatory variable being first multi-dimensional data obtained by transforming past rolling performance data including pre-cold rolling data of a roll material on an entry side of the cold rolling mill into multi-dimensional data, and the objective variable being post-cold rolling data of the roll material on a delivery side of the cold rolling mill. The method includes: a step of estimating a post-rolling shape of the roll target material on the delivery side of the cold rolling mill by inputting, to the prediction model, second multi-dimensional data generated from information including the pre-cold rolling data of the roll target material on the entry side of the cold rolling mill and a target rolling condition of the cold rolling mill; and a step of changing the target rolling condition of the cold rolling mill such that the estimated post-rolling shape of the roll target material satisfies a predetermined condition.

Moreover, the pre-cold rolling data may include at least one of thickness information of the steel sheet and temperature information of the steel sheet, on the entry side of the cold rolling mill.

Moreover, the post-cold rolling data may include shape parameters calculated from the shape of the steel sheet on the delivery side of the cold rolling mill.

Moreover, a cold rolling method according to the present invention includes a step of performing a cold rolling of a roll target material using a target rolling condition of the cold rolling mill changed using the cold rolling mill rolling condition setting method according to the present invention.

Moreover, a steel sheet manufacturing method according to the present invention includes a step of manufacturing a steel sheet using the cold rolling method according to the present invention.

Moreover, a cold rolling mill rolling condition setting device according to the present invention is the device of setting a target rolling condition of a cold rolling mill when a roll target material is rolled by cold rolling using a prediction model that predicts a post-cold rolling state of the roll target material, the prediction model being generated with an explanatory variable and an objective variable, the explanatory variable being first multi-dimensional data obtained by transforming past rolling performance data including pre-cold rolling data of a roll material on an entry side of the cold rolling mill into multi-dimensional data, and the objective variable being post-cold rolling data of the roll material on a delivery side of the cold rolling mill. The device includes: a means of estimating a post-rolling shape of the roll target material on the delivery side of the cold rolling mill by inputting, to the prediction model, second multi-dimensional data generated from information including the pre-cold rolling data of the roll target material on the entry side of the cold rolling mill and a target rolling condition of the cold rolling mill; and a means of changing the target rolling condition of the cold rolling mill such that the estimated post-rolling shape of the roll target material satisfies a predetermined condition.

Moreover, the pre-cold rolling data may include at least one of thickness information of the steel sheet and temperature information of the steel sheet, on the entry side of the cold rolling mill.

Moreover, the post-cold rolling data may include shape parameters calculated from the shape of the steel sheet on the delivery side of the cold rolling mill.

Moreover, a cold rolling mill according to the present invention includes the cold rolling mill rolling condition setting device according to the present invention.

Advantageous Effects of Invention

According to the cold rolling mill rolling condition setting method and the cold rolling mill rolling condition setting device of the present invention, it is possible to set rolling conditions for performing cold rolling with high productivity while ensuring stability of cold rolling even when a difficult-to-roll material with a high load and a small pre-rolling sheet thickness. In addition, according to the cold rolling method and the cold rolling mill of the present invention, it is possible to perform cold rolling with high productivity while ensuring stability of cold rolling even when cold-rolling a difficult-to-roll material with a high load and a small pre-rolling sheet thickness. Further, according to the steel sheet manufacturing method of the present invention, it is possible to manufacture a steel sheet with high yield.

DESCRIPTION OF EMBODIMENTS

Hereinafter, a cold rolling mill rolling condition setting method, a cold rolling method, a steel sheet manufacturing method, a cold rolling mill rolling condition setting device, and a cold rolling mill according to an embodiment of the present invention will be described with reference to the drawings. Note that the following embodiments illustrate devices and methods for embodying the technical idea of the present invention, and are not to be limited to the material, shape, structure, arrangement, and the like of the components in the following embodiments. The drawings are schematic illustrations. For this reason, it should be noted that the relationship, ratio, and the like between the thickness and the planar dimensions are different from actual measurements, and there are portions in which the relationship and ratio of the dimensions are different between the drawings.

[Configuration of Cold Rolling Mill]

First, a configuration of a cold rolling mill according to an embodiment of the present invention will be described with reference to FIG. 1. In the present description, "cold rolling" may be simply referred to as "rolling", and thus, "cold rolling" and "rolling" are synonymous in the present description. In the following description, a steel sheet will be described as an example of a roll material (roll target material) to be rolled by a cold rolling mill. However, the roll material is not limited to a steel sheet, and may be other metal sheet such as an aluminum sheet.

Figure 1:
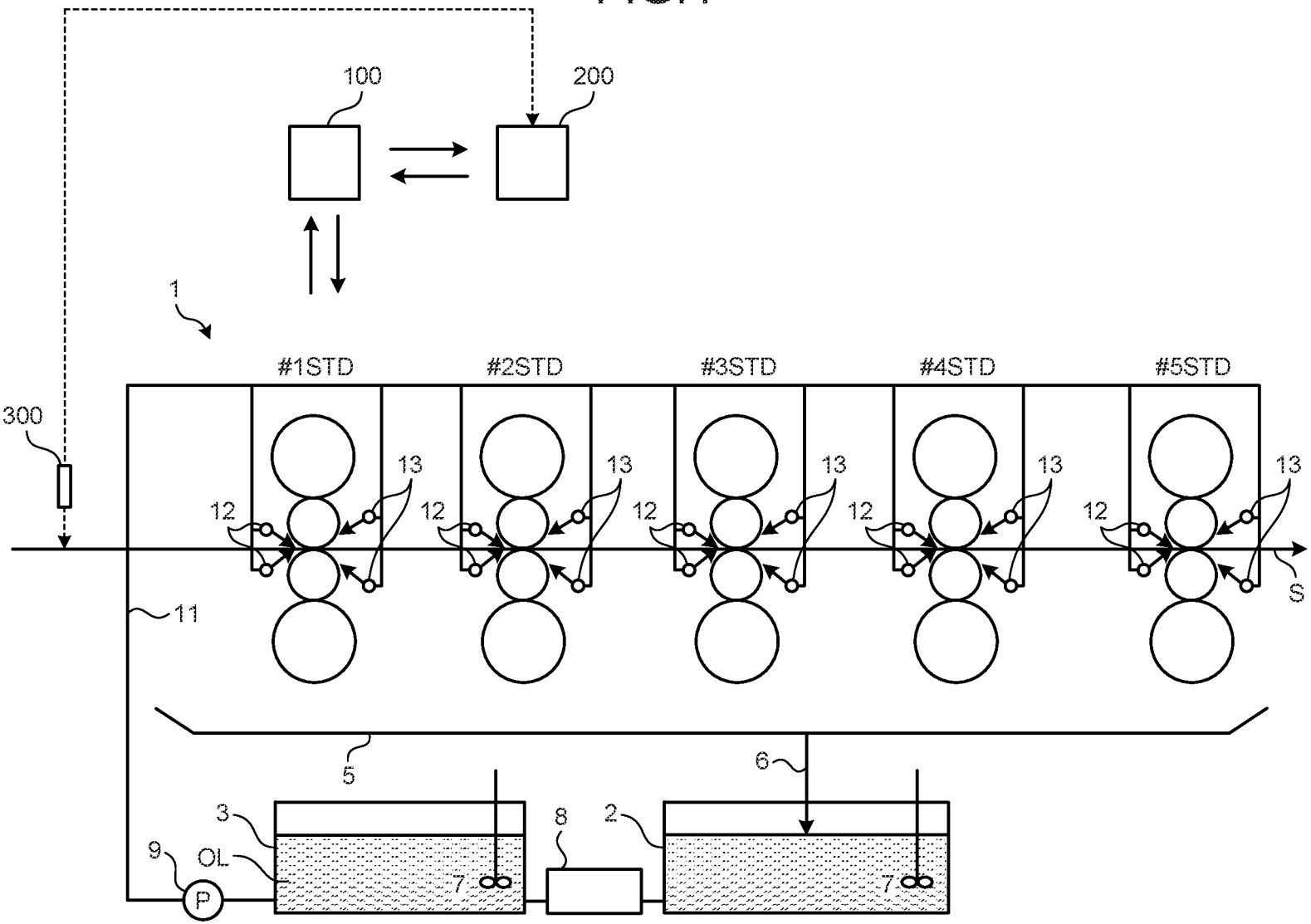
FIG. 1 is a schematic diagram illustrating a configuration of a cold rolling mill according to an embodiment of the present invention.

FIG. 1 is a schematic diagram illustrating a configuration of a cold rolling mill according to an embodiment of the present invention. As illustrated in FIG. 1, a cold rolling mill 1 according to an embodiment of the present invention is a tandem cold rolling mill provided with five rolling stands, namely, a first rolling stand to a fifth rolling stand (#1STD to #5STD) in order from an entry side (left side as viewed in the plane of drawing of FIG. 1) toward a delivery side (right side as viewed in the plane of drawing of FIG. 1) of a steel sheet S. In the cold rolling mill 1, devices (not illustrated) such as a tension roll and a differential roll, a sheet thickness meter, and a profilometer are appropriately installed between adjacent rolling stands. The configuration of the rolling stands, a conveyor of the steel sheet S, and the like are not particularly limited, and known technologies are applicable.

Each rolling stand of the cold rolling mill 1 is supplied with an emulsion rolling oil OL (in the following description, "emulsion rolling oil" may be simply referred to as "rolling oil"). The cold rolling mill 1 includes a dirty oil tank (recovery tank) 2 and a clean oil tank 3 as rolling oil OL storage tanks, and the rolling oil OL supplied from these tanks is supplied to each rolling stand through a supply line 11.

The rolling oil recovered by an oil pan 5 disposed below the first to fifth rolling stands, that is, the rolling oil used in the cold rolling flows into the dirty oil tank 2 through a return pipe 6.

The rolling oil OL stored in the clean oil tank 3 is a rolling oil generated by mixing hot water (diluted water) and a stock solution of the rolling oil OL (to which a surfactant has been added). By adjusting the rotation speed of a stirring blade of a stirrer 7, that is, by adjusting the degree of stirring, the mixture of the hot water and the rolling oil stock solution is made into a rolling oil OL having a desired average particle diameter and concentration range.

The stock solution of the rolling oil may be a stock solution used in normal cold rolling, for example, it is possible to use a stock solution having any of natural oil, fatty acid ester, and hydrocarbon-based synthetic lubricating oil as a base oil. Furthermore, these rolling oils may include additives used for ordinary cold rolling oils such as oil improvers, extreme pressure additives, and antioxidants.

The surfactant added to the rolling oil may be either an ionic surfactant or a nonionic surfactant, and it is allowable to use a surfactant used in a normal circulation type coolant system (circulation type rolling oil supply system). The stock solution of the rolling oil is to be diluted to a concentration of preferably 2 to 8 mass % and more preferably 3 to 6.0 mass- to obtain O/W emulsion rolling oil in which oil is dispersed in water using a surfactant. The average particle diameter of the rolling oil is preferably 15 μm or less, and more preferably 3 to 10 μm.

After the start of the operation, the rolling oil recovered in the dirty oil tank 2 flows into the clean oil tank 3 via an iron powder remover 8 formed with a device such as an iron powder amount controller. The rolling oil recovered in the dirty oil tank 2 contains abrasion powder (iron powder) generated by friction between the rolling roll and the steel sheet S. Therefore, the iron powder remover 8 removes the abrasion powder so that the oil-soluble iron content of the recovered rolling oil will be an oil-soluble iron content acceptable as the rolling oil OL to be stored in the clean oil tank 3.

The movement of the rolling oil from the dirty oil tank 2 to the clean oil tank 3 via the iron powder remover 8 may be performed continuously or intermittently. The iron powder remover 8 may preferably be, but not limited to, a device that adsorbs and removes iron powder using a magnet filter such as an electromagnetic filter or a magnet separator. The iron powder remover 8 may be a known device using a method such as centrifugal separation.

Meanwhile, the rolling oil supplied to the rolling stand is partially taken out of the system by the steel sheet S or lost by evaporation. Therefore, the clean oil tank 3 has a configuration in which the stock solution of the rolling oil OL is appropriately fed (supplied) from a stock solution tank (not illustrated) so that the storage level and concentration of the rolling oil OL in the clean oil tank 3 are within predetermined ranges. In addition, hot water for diluting the rolling oil is also fed (supplied) to the clean oil tank 3 as appropriate. The storage level and concentration of the emulsion rolling oil OL in the clean oil tank 3 can be measured by a sensor (not illustrated).

Next, the rolling oil supply system in the cold rolling mill 1 will be described in detail. The rolling oil OL supply system in the cold rolling mill 1 includes the dirty oil tank 2, the iron powder remover 8, the clean oil tank 3, and a pump 9 that sucks the rolling oil OL from the clean oil tank 3. It is also allowable to dispose a foreign body removal strainer between the clean oil tank 3 and the pump 9.

The rolling oil supply system in the cold rolling mill 1 includes: a supply line 11 having one end connected to the clean oil tank 3; and five sets of lubricating coolant headers 12 and five sets of cooling coolant headers 13, which are branched at the other end (rolling mill side) of the supply line 11 and disposed at positions corresponding to the individual rolling stands.

Each lubricating coolant header 12 is disposed on the entry side of the rolling stand, and injects rolling oil OL as lubricating oil from spray nozzles individually provided toward the roll bite to supply the lubricating oil to the roll bite and the work roll. The cooling coolant header 13 is disposed on the delivery side of the rolling stand, and cools the rolling roll by injecting the rolling oil OL from individual spray nozzles to the rolling roll.

With such a configuration, the emulsion rolling oil OL in the clean oil tank 3 is pressure-fed to the supply line 11 by the pump 9, supplied to the lubricating coolant header 12 and the cooling coolant header 13 disposed in each rolling stand, and supplied to the injection site from the spray nozzles provided in each rolling stand. The emulsion rolling oil OL supplied to the rolling roll is recovered to the oil pan 5 except for the emulsion rolling oil OL taken out of the system by the steel sheet S or the emulsion rolling oil OL lost by evaporation, and is then returned to the dirty oil tank 2 through the return pipe 6. Thereafter, a part of the emulsion rolling oil stored in the dirty oil tank 2 is returned into the clean oil tank 3 after a certain amount of the oil-soluble iron content generated by the cold rolling has been removed using the iron powder remover 8.

By the rolling oil supply system described above, the rolling oil after abrasion content removal processing is supplied, in circulation, to the rolling roll. That is, the supplied emulsion rolling oil is used in circulation. Note that the clean oil tank 3 corresponds to a rolling oil tank for circulation in a conventional circulation oil supply system, and as described above, a stock solution of rolling oil is appropriately fed (supplied) to the clean oil tank 3.

[Shape Control Prediction Model]

Next, a shape control prediction model according to an embodiment of the present invention will be described with reference to FIGS. 1 to 6.

Functions related to the shape control prediction model according to an embodiment of the present invention are implemented by a rolling control device 100, an arithmetic unit 200, and a steel sheet information measurement device 300 illustrated in FIG. 1.

The rolling control device 100 controls rolling conditions of the cold rolling mill 1 based on a control signal from the arithmetic unit 200.

Figure 2:
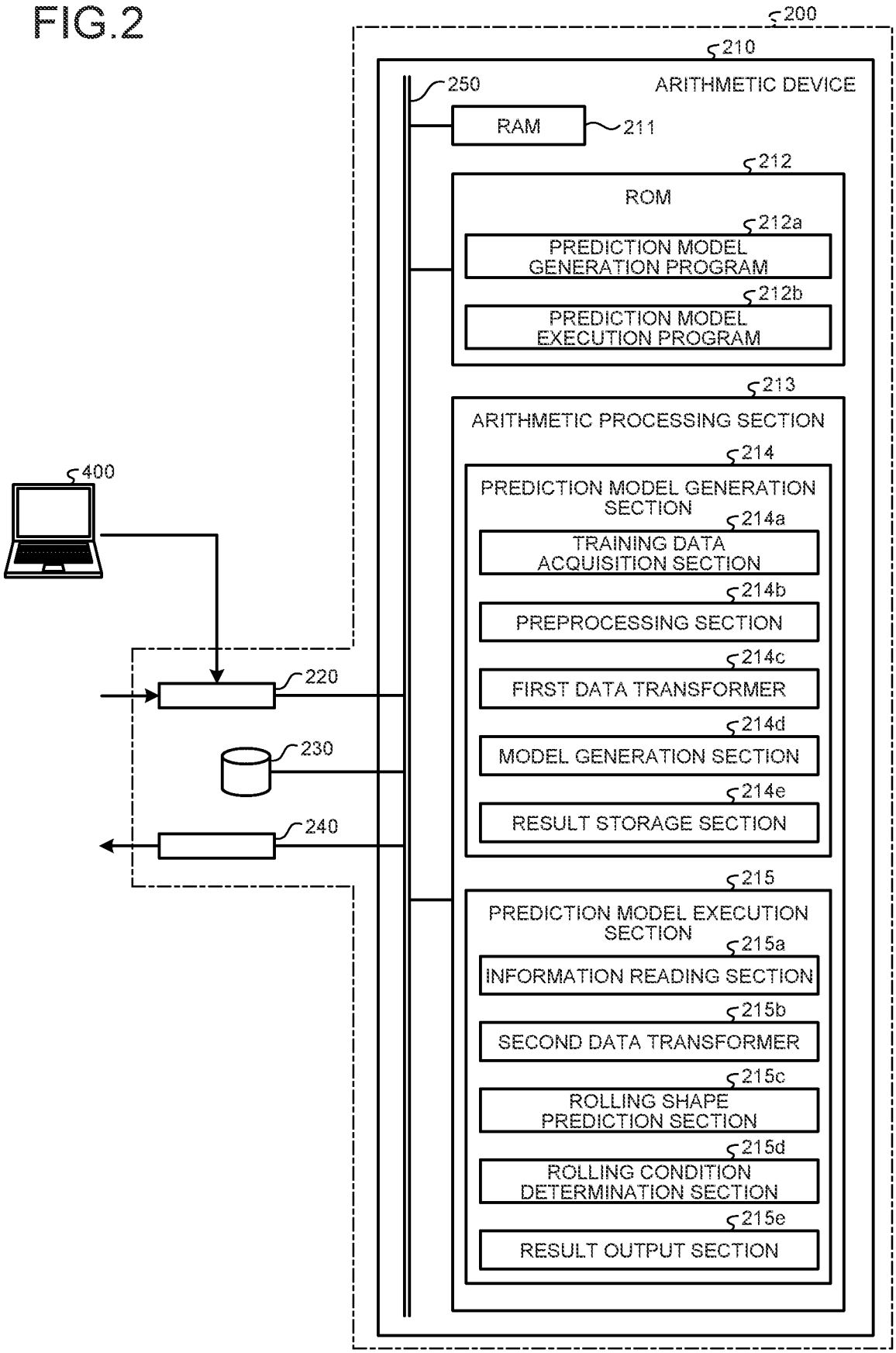
FIG. 2 is a block diagram illustrating a configuration of an arithmetic unit illustrated in FIG. 1.

FIG. 2 is a block diagram illustrating a configuration of the arithmetic unit 200 illustrated in FIG. 1. As illustrated in FIG. 2, the arithmetic unit 200 includes an arithmetic device 210, an input device 220, a storage device 230, and an output device 240.

The arithmetic device 210 is connected, in wired connection, to the input device 220, the storage device 230, and the output device 240 via a bus 250. However, connection among the arithmetic device 210, the input device 220, the storage device 230, and the output device 240 is not limited to this mode of connection, and may be connected wirelessly, or may be connected in a combination of wired and wireless connections.

The input device 220 functions as an input port that receives input of control information of the cold rolling mill 1 by the rolling control device 100, rolling entry-side steel sheet information (information related to the steel sheet S on the entry side of the cold rolling mill 1 (for example, a steel type, a pre-rolling sheet thickness and sheet width) measured by the steel sheet information measurement device 300, and information from an operation monitoring device 400 are input. The information from the operation monitoring device 400 includes execution command information of a shape control prediction model, information regarding the steel sheet S being a roll target (Pre-processing conditions, steel type, and size), and cold rolling condition information (numerical information, character information, and image information) set by a process computer or an operator before cold rolling.

The storage device 230 is a device that includes components such as a hard disk drive, a semiconductor drive, an optical drive, for example, and that stores information necessary for the present system (information necessary for implementation of the functionalities of a prediction model generation section 214 and the prediction model execution section 215 described below).

Examples of information necessary for implementation of the functionalities of the prediction model generation section 214 include: rolling entry-side steel sheet information and required characteristics of the steel sheet S (steel type, product sheet thickness, sheet width, etc.) measured by the steel sheet information measurement device 300; facility constraints of the cold rolling mill 1; rolling information after passing through a welding point of the steel sheet S (including coil information and shape actuator position); properties of coolant used in a rolling stand; explanatory variables related to cold rolling such as rolling conditions (including target rolling speed); and information indicating objective variables related to cold rolling, such as rolling delivery-side steel sheet information (including shape parameters such as a 1st to 4th order components of the delivery-side steel sheet shape, steepness, and an edge drop ratio (sheet thickness reduction rate at the end of the steel sheet)).

Components $\Lambda 1$ to $\Lambda 4$, which are 1st to 4th order components of the delivery-side steel sheet shape, can be respectively calculated using the following Formulas (1) to (4). That is, shape parameters $\Lambda 2$ and $\Lambda 4$ representing symmetric components are respectively calculated by the following Formulas (1) and (2), while the shape parameters $\Lambda 1$ and $\Lambda 3$ representing asymmetric components are respectively calculated by the following Formulas (3) and (4). However, the parameters $\lambda 1$ to $\lambda 4$ in the Formulas (1) to (4) indicate coefficients when the steel sheet shape Y is approximated by a quartic expression function in the following Formula (5), taking an elongation percentage as the steel sheet shape Y, taking a non-dimensional coordinate x ($-1 \le x \le 1$) with a sheet width in the width direction. In addition, the steepness is a value defined by $\lambda = \delta/P$ using a height $\delta$ of the wave of the rolled steel sheet S and its pitch P.

$$\Lambda 2 = \lambda 2 + \lambda 4 \tag{1}$$

$$\Lambda 4 = (1/2) \times \lambda 2 + (1/4) \times \lambda 4 \tag{2}$$

$$\Lambda 1 = \lambda 1 + \lambda 3 \tag{3}$$

$$\Lambda 3 = (1/\sqrt{3}) \times \lambda 1 + (1/3\sqrt{3}) \times \lambda 3 \tag{4}$$

$$Y = \lambda 0 + \lambda 1 \times x + \lambda 2 \times x^2 + \lambda 3 \times x^3 + \lambda 4 \times x^4 \tag{5}$$

Examples of the information necessary for implementation of the functionalities of the prediction model execution section 215 include a shape control prediction model for each of the rolling states of the steel sheet S generated by the prediction model generation section 214 and various types of information and shape constraint condition to be input to the shape control prediction model. Here, the shape constraint condition is a condition being a criterion for determining the pass/fail of the shape of the steel sheet on the delivery side of the cold rolling mill 1. For example, a range determined as pass is appropriately preset for each of the 1st to 4th order components, the steepness, and the edge drop ratio of the delivery-side steel sheet shape described above.

The output device 240 functions as an output port that outputs a control signal from the arithmetic device 210 to the rolling control device 100.

The operation monitoring device 400 includes any type of display device such as a liquid crystal display or an organic display. The operation monitoring device 400 receives various types of information indicating operational states of the cold rolling mill 1 from the rolling control device 100, and displays the received information on an operation screen (operational screen) for the operator to monitor the operational state of the cold rolling mill 1.

The arithmetic device 210 includes random access memory (RAM) 211, read only memory (ROM) 212, and an arithmetic processing section 213.

The ROM 212 stores a prediction model generation program 212*a* and a prediction model execution program 212*b* which are computer programs.

The arithmetic processing section 213 has an arithmetic processing function and is connected to the RAM 211 and the ROM 212 via a bus 250.

The RAM 211, the ROM 212, and the arithmetic processing section 213 are connected to the input device 220, the storage device 230, and the output device 240 via the bus 250.

The arithmetic processing section 213 includes a prediction model generation section 214 and a prediction model execution section 215 as functional blocks.

The prediction model generation section 214 is a processing section that generates a shape control prediction model by a machine learning method that links the pre-rolling data and rolling conditions of the steel sheet S among past rolling performance in the cold rolling mill 1 with the post-rolling data of the steel sheet S corresponding to each piece of the pre-rolling data among the past rolling performance. In the present embodiment, a neural network model is used as a shape control prediction model to be created by the machine learning method. Note that the machine learning method is not limited to the neural network, and other known machine learning methods may be adopted.

The prediction model generation section 214 includes a training data acquisition section 214*a*, a preprocessing section 214*b*, a first data transformer 214*c*, a model generation section 214*d*, and a result storage section 214*e*. When having received an instruction to generate a shape control prediction model from the operation monitoring device 400, the prediction model generation section 214 executes the prediction model generation program 212*a* stored in the ROM 212, thereby functioning as the training data acquisition section 214*a*, the preprocessing section 214*b*, the first data transformer 214*c*, the model generation section 214*d*, and the result storage section 214*e*. The shape control prediction model is updated each time of execution of the model by the prediction model generation section 214.

As preprocessing for generating the shape control prediction model, the training data acquisition section 214*a* acquires a plurality of pieces of training data in which the rolling entry-side steel sheet information and the rolling conditions from the steel sheet information measurement device 300 are set as input performance data (explanatory variable) and the rolling delivery-side steel sheet information is set as output performance data (objective variable) among the past rolling performance data. Specifically, the training data acquisition section 214*a* acquires a plurality of pieces of training data in which at least one of sheet thickness information and temperature information in the width direction and the longitudinal direction of the steel sheet S measured on the entry side of the rolling mill and past rolling performance in the coil are set as input performance data, and shape parameters calculated from the steel sheet shape on the delivery side of the cold rolling mill 1 during cold rolling using the input performance data are set as output performance data. The training data acquisition section 214*a* acquires the input performance data and the output performance data from the storage device 230 to create training data. Each training data includes a set of input performance data and output performance data. The training data is stored in the storage device 230. The training data acquisition section 214*a* may supply the training data to the preprocessing section 214*b* or the model generation section 214*d* without storing the training data in the storage device 230.

The input performance data includes multi-dimensional array information in which explanatory variables are joined in the time direction. In the present embodiment, information as illustrated in FIGS. 3(*a*) to 3(*c*) is adopted as the multi-dimensional array information.

Figure 3:
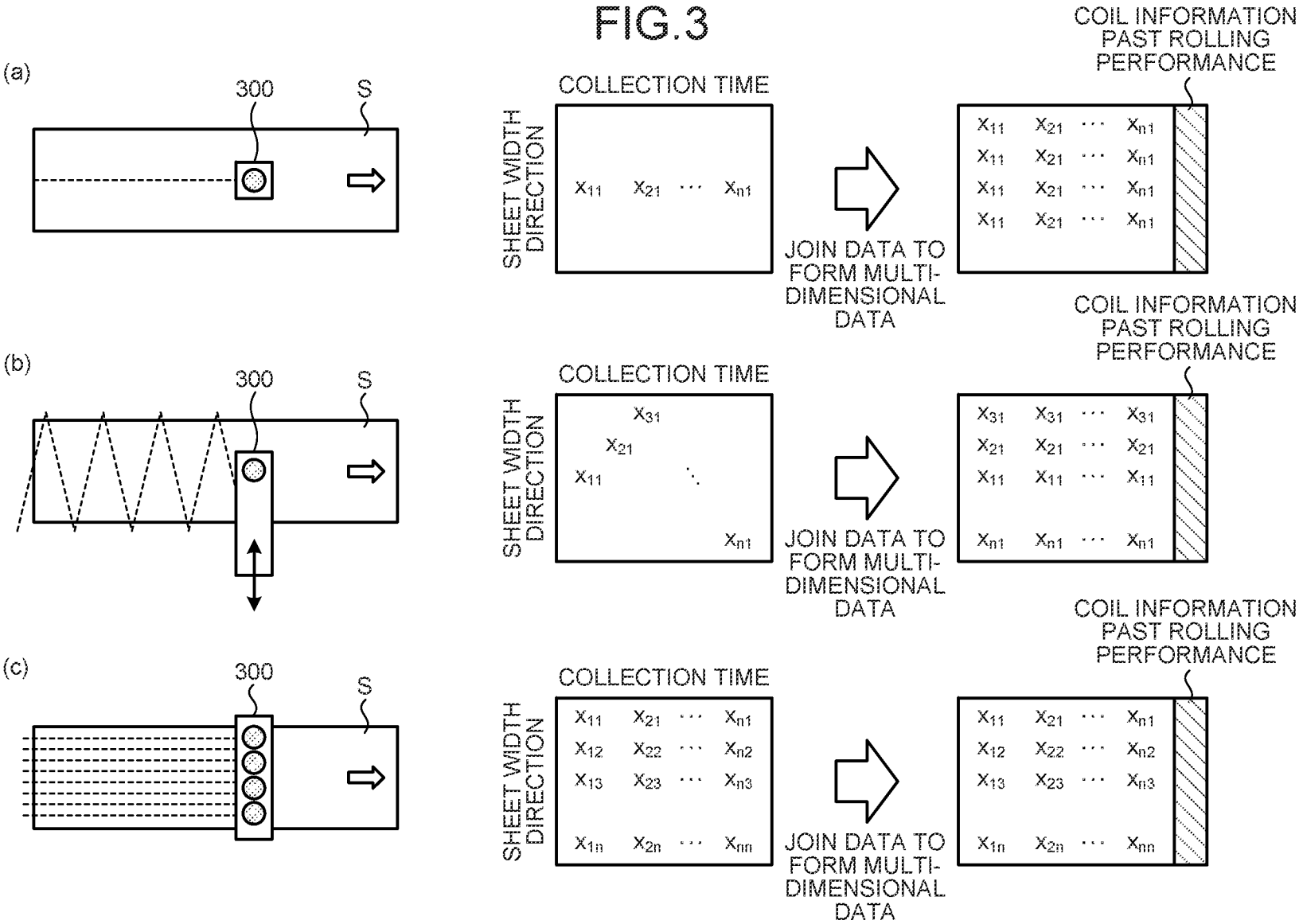
FIG. 3 is a diagram illustrating an example of multi-dimensional array information.

FIG. 3(*a*) illustrates an example in a case where the number of measurement points of the steel sheet information measurement device 300 is one. In this case, the training data acquisition section 214*a* duplicates data in the width direction of the steel sheet S with respect to measurement points continuously measured in the longitudinal direction of the steel sheet S, creates an array in which a column (vertical direction) is the width direction and a row (horizontal direction) is a collection pitch, and further creates multi-dimensional array information in which information of the coil and explanatory variables selected from past rolling performances are joined to each other, and sets the created multi-dimensional array information as input performance data. The number of columns, rows, and explanatory variables is not particularly limited.

FIG. 3(*b*) illustrates an example in which the measurement point of the steel sheet information measurement device 300 is scanned in the width direction of the steel sheet S. In this case, the training data acquisition section 214*a* duplicates data in the longitudinal direction of the steel sheet S with respect to measurement points which have been measured continuously and wavy in the longitudinal direction of the steel sheet S. Similarly to the example illustrated in FIG. 3(*a*), multi-dimensional array information joining the explanatory variables is created and set as input performance data.

FIG. 3(*c*) illustrates an example in which the steel sheet information measurement device 300 has a plurality of measurement points in the width direction of the steel sheet S. In this case, similarly to the example illustrated in FIG. 3(*a*), the training data acquisition section 214*a* creates multi-dimensional array information by joining the explanatory variables to a measurement point group continuously measured in the longitudinal direction of the steel sheet S, and sets the created multi-dimensional array information as input performance data.

The information measured by the steel sheet information measurement device 300 is at least one of the sheet thickness and the temperature information. The measurement method used by a sheet thickness meter is not particularly limited, and may be a contact method or a non-contact method (γ-rays, X-rays, etc.). Similarly, a thermometer is not limited, and may use a contact method or a non-contact method such as a radiation thermometer. When the steel sheet information measurement device 300 is a thermometer, a steel sheet heating device for applying temperature to the steel sheet S may be installed on the upstream side.

When past rolling performance data is not stored in the storage device 230 (for example, in the case of rolling conditions or steel type conditions having no past performance) or when the sample volume is small, the training data acquisition section 214*a* requests the operator to execute cold rolling one or a plurality of times without using the shape control prediction model. In addition, the more the number of pieces of training data stored in the storage device 230, the higher the prediction accuracy to be achieved by the shape control prediction model. Therefore, when the number of training data is less than a preset threshold, the training data acquisition section 214*a* may request the operator to execute cold rolling without using the shape control prediction model until the number of pieces of data reaches the threshold.

The preprocessing section 214*b* processes the training data acquired by the training data acquisition section 214*a* to be adapted for generation of the shape control prediction model. Specifically, the preprocessing section 214*b* standardizes (normalizes) the value range of the input performance data between 0 to 1 as necessary in order to allow the rolling performance data constituting the training data to be loaded to the neural network model.

The input performance data is multi-dimensional information. Therefore, the first data transformer 214*c* performs dimensionality reduction on the input performance data in a state where features are retained using a convolutional neural network to transform the data into one-dimensional information (refer to FIG. 4). The input performance data is connected to an input layer 501 of the neural network model illustrated in FIG. 4 as one-dimensional information.

Figure 5:
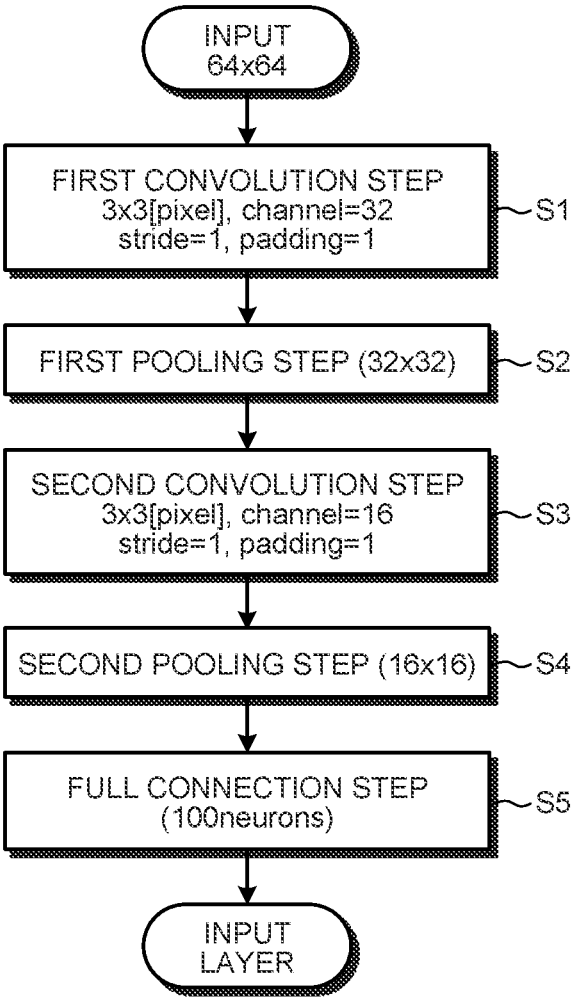
FIG. 5 is a flowchart illustrating a flow of processing of transforming multi-dimensional array information into one-dimensional information.

Here, a processing example of the first data transformer 214*c* will be described with reference to FIG. 5. FIG. 5 is a flowchart illustrating a flow of processing of transforming multi-dimensional array information into one-dimensional information. As illustrated in FIG. 5, the processing of transforming the multi-dimensional array information into the one-dimensional information, that is, the method of storing the multi-dimensional array information uses a structure in which inputs and outputs of a plurality of filters are connected in multiple stages. That is, the processing of transforming the multi-dimensional array information into the one-dimensional information includes, in order from the input side, a first convolution step S1, a first pooling step S2, a second convolution step S3, a second pooling step S4, and a full connection step S5.

In the first convolution step S1, the first data transformer 214*c* uses multi-dimensional array information of a row×column pattern of 64×64 as input, and outputs a first feature map of a pattern of 64×64 by convolution operation. The first feature map indicates where and what type of local features are present in the input array. In the convolution operation, for example, a filter of a row×column pattern of 3×3 pixels and 32 channels is used, an application interval of the filter is set to 1, and a length of filling (padding) the periphery with 0 is set to 1.

In the first pooling step S2, the first data transformer 214*c* uses the first feature map output in the first convolution step S1 as an input, and sets the maximum value of the first feature map within a row×column pattern of 3×3 pixels as a new one pixel. The first data transformer 214*c* performs such an operation over the entire map while shifting pixels. With this operation, in the first pooling step S2, the first data transformer 214*c* outputs a second feature map obtained by compressing the first feature map.

In the second convolution step S3, the first data transformer 214*c* uses the second feature map as input, and outputs a third feature map by convolution operation. In the convolution operation, for example, a filter of a row×column pattern of 3×3 pixels and 16 channels is used, an application interval of the filter is set to 1, and a length of filling (padding) the periphery with 0 is set to 1.

In the second pooling step S4, the first data transformer 214*c* uses the third feature map output in the second convolution step S3 as an input, and sets the maximum value of the third feature map within a row×column pattern of 3×3 pixels as a new one pixel. The first data transformer 214*c* performs such an operation over the entire map while shifting pixels. With this operation, in the second pooling step S4, the first data transformer 214*c* outputs a fourth feature map obtained by compressing the third feature map.

In the full connection step S5, the first data transformer 214*c* lines up the information of the fourth feature map output in the second pooling step S4. Subsequently, 100 neurons output from the full connection step S5 make the input layer 501 of the neural network model illustrated in FIG. 4. Note that the convolution method and the number of output neurons are not limited to those described above. Furthermore, the method of the convolutional neural network may be implemented by using a known model such as GoogleNet, VGG 16, MOBILENET, or EFFICIENTNET.

Returning to FIG. 2. By machine learning (including information transformed by the first data transformer 214*c*) using a plurality of pieces of training data acquired by the preprocessing section 214*b*, the model generation section 214*d* generates a shape control prediction model that includes rolling entry-side steel sheet information and explanatory variables (the coil information and past rolling performance) as input performance data and has rolling delivery-side steel sheet information as output performance data.

The present embodiment adopts a neural network as a machine learning method, and accordingly, the model generation section 214*d* generates a neural network model as the shape control prediction model. That is, the model generation section 214*d* generates a neural network model as a shape control prediction model that links input performance data (rolling performance data including rolling entry-side steel sheet information) with output performance data (rolling delivery-side steel sheet information) in training data processed for shape control prediction model generation. The neural network model is expressed by a functional formula, for example.

Specifically, the model generation section 214*d* performs setting of hyperparameters to be used for the neural network model, and performs learning with the neural network model using the hyperparameters. As an optimization calculation of the hyperparameter, the model generation section 214*d* first generates a neural network model in which some of the hyperparameters have been changed in stages for the training data, and selects the hyperparameter capable of achieving the highest prediction accuracy for the verification data.

Items usually set as the hyperparameter include, but not limited to, the number of hidden layers, the number of neurons in each hidden layer, the dropout rate in each hidden layer (blocking the transmission of neurons with a certain probability), the activation function in each hidden layer, and the number of outputs. In addition, examples of the hyperparameter optimization method can include, but not particularly limited to, a grid search of changing parameters in stages, a random search of randomly selecting parameters, or Bayesian optimization search.

Although the model generation section 214*d* is incorporated as a part of the arithmetic device 210, the configuration is not limited thereto. For example, a shape control prediction model may be generated and stored in advance, and they may be read as appropriate.

Figure 4:
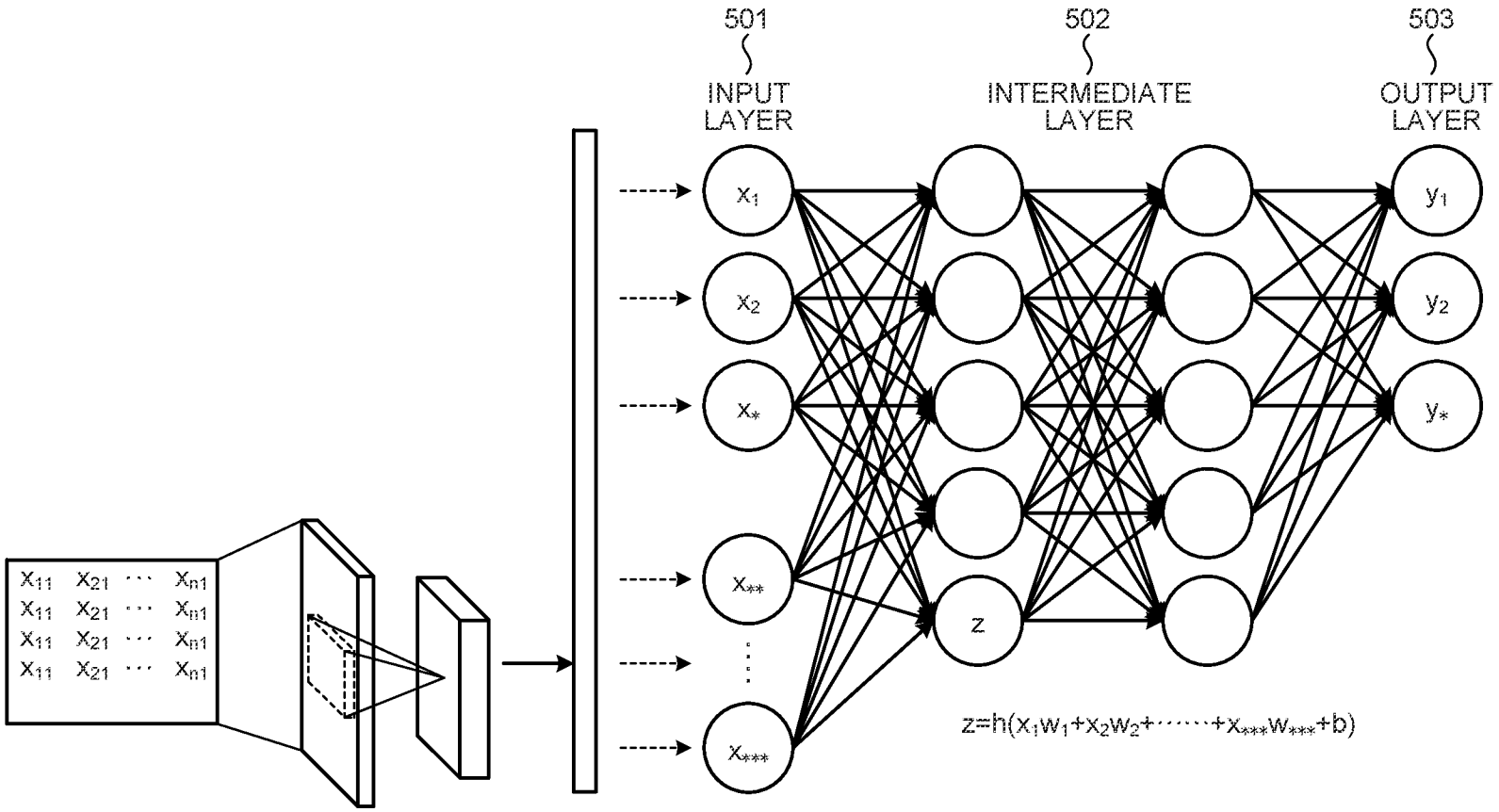
FIG. 4 is a diagram illustrating a configuration example of a shape control prediction model.

As illustrated in FIG. 4, the neural network model as the shape control prediction model in the present embodiment includes an input layer 501, an intermediate layer 502, and an output layer 503 in order from the entry side.

The multi-dimensional array information created in FIG. 3 undergoes dimensionality reduction by the training data acquisition section 214*a* in a state where the features are retained using the convolutional neural network, and is stored in the input layer 501 in a state of being transformed into one-dimensional information.

The intermediate layer 502 includes a plurality of hidden layers, and each of the hidden layers includes a plurality of neurons. The number of hidden layers formed in the intermediate layer 502 and the number of neurons arranged in each hidden layer are not particularly limited. In the intermediate layer 502, transmission of a neuron from a certain neuron to a subsequent hidden layer is performed via an activation function together with weighting of a variable by a weighting factor. As the activation function, a Sigmoid function, a hyperbolic tangent function, or a ramp function can be used.

The neuron information transmitted by the intermediate layer 502 is connected onto the output layer 503, and the result is output as a final shape constraint determination value for cold rolling. The number of outputs to be formed in the output layer 503 is not particularly limited. Learning is performed by gradually optimizing the weighting factor in the neural network model based on the output result, past rolling performance (rolling entry-side steel sheet information and operating conditions) at the time of cold rolling of the steel sheet S, and based on rolling constraint performance (sheet shape determination) at that time.

After the weighting factor of the neural network model has been learned, the model generation section 214*d* inputs evaluation data (rolling condition performance of the steel sheet S being a roll target using the shape control prediction model) to the neural network model that has learned the weighting factor, and obtains an estimation result for the evaluation data.

Returning to FIG. 2. The result storage section 214*e* stores, in the storage device 230, the training data, the evaluation data, the parameter (weighting factor) of the neural network model, the output result of the neural network model for the training data, and the output result of the neural network model for the evaluation data.

During the cold rolling of the steel sheet S, the prediction model execution section 215 predicts the shape parameters of the steel sheet S after the cold rolling corresponding to the rolling condition of the steel sheet S being a roll target using the shape control prediction model generated by the prediction model generation section 214. The prediction model execution section 215 then determines the target rolling condition of the steel sheet S being a roll target.

In order to perform the above processing, the prediction model execution section 215 includes an information reading section 215*a*, a second data transformer 215*b*, a rolling shape prediction section 215*c*, a rolling condition determination section 215*d*, and a result output section 215*e*. Here, when having received a signal notifying that cold rolling is being performed from the rolling control device 100 via the input device 220, the prediction model execution section 215 executes the prediction model execution program 212*b* stored in the ROM 212, thereby functioning as the information reading section 215*a*, the second data transformer 215*b*, the rolling shape prediction section 215*c*, the rolling condition determination section 215*d*, and the result output section 215*e*.

The information reading section 215*a* reads the rolling conditions of the steel sheet S being a roll target set by a process computer and an operator in the operation monitoring device 400 from the storage device 230.

The second data transformer 215*b* performs convolution processing of transforming the multi-dimensional array information, which will be input data to the shape control prediction model, into one-dimensional information. Since the processing of the second data transformer 215*b* is the same as the processing of the first data transformer 214*c*, detailed description of the processing will be omitted. The first data transformer 214*c* and the second data transformer 215*b* may be set as subroutine as one processing section.

The rolling shape prediction section 215*c* inputs the one-dimensional information after convolution by the second data transformer 215*b* to the shape control prediction model to predict the shape parameters on the delivery side of the cold rolling mill of the steel sheet S being a roll target.

The rolling condition determination section 215*d* changes the setting of the target rolling condition in the explanatory variable so that the shape parameter of the steel sheet S is within a separately set shape constraint determination threshold, and repeatedly returns to the execution of the processing of the information reading section 215*a*, the second data transformer 215*b*, and the rolling shape prediction section 215*c*.

The result output section 215*e* operates when the shape parameter of the steel sheet S after rolling falls within a preset shape constraint determination threshold, and outputs the determined rolling condition (shape control actuator amount) of the steel sheet S being a roll target.

Next, processing of the prediction model execution section 215 will be described with reference to FIG. 6.

Figure 6:
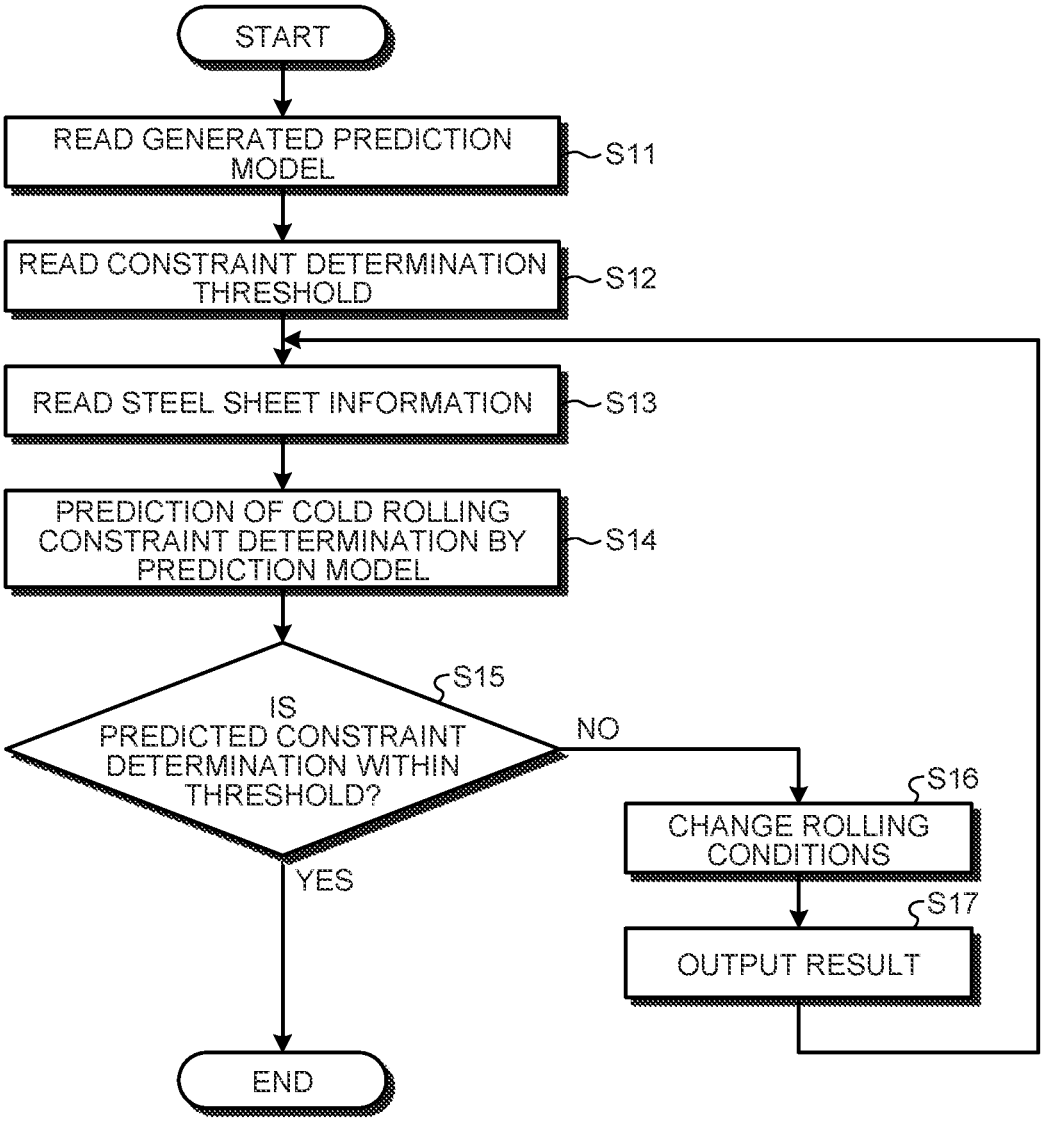
FIG. 6 is a flowchart illustrating a flow of processing performed by a prediction model execution section.

FIG. 6 is a flowchart illustrating a flow of processing of the prediction model execution section 215. As illustrated in FIG. 6, as first processing of step S11 in execution of the shape control prediction model, the information reading section 215*a* of the prediction model execution section 215 reads, from the storage device 230, a neural network model as a shape control prediction model corresponding to the required characteristics of the steel sheet S being a roll target.

Next, in the processing of step S12, the information reading section 215*a* reads a required shape constraint determination threshold stored in the storage device 230 from a host computer via the input device 220. Next, the information reading section 215*a* reads, in the processing of step S13, the rolling conditions of the steel sheet S being a roll target stored in the storage device 230 from the host computer via the input device 220.

Next, in the processing of step S14, the rolling shape prediction section 215*c* obtains a shape parameter of the corresponding steel sheet S undergoing cold rolling by setting, as the input performance data, the data in which the rolling conditions of the steel sheet S being a roll target read in the processing of step S13 are put in multi-dimensional array, by using the neural network model as the shape control prediction model read in the processing of step S11. Note that the prediction result by the neural network model is output to the output layer 503 of the neural network model illustrated in FIG. 4.

Next, as the processing of step S15, the rolling condition determination section 215*d* determines whether the shape parameter of the steel sheet S obtained in the processing of step S14 is within the shape constraint determination threshold read in the processing of step S12. Note that, when the calculation has not been sufficiently converged, an upper limit may be set to the number of iterations of convergence within a range of calculation time that can be actually executed in the processing of step S15. Note that the fact that the shape parameter is within the shape constraint determination threshold corresponds to satisfaction of a predetermined condition in the present invention.

In a case where the shape parameter is within the shape constraint determination threshold (step S15: Yes), the prediction model execution section 215 ends the series of processing. In contrast, when the shape parameter is not within the shape constraint determination threshold (step S15: No), the prediction model execution section 215 proceeds to the processing of step S16.

In the processing of step S16, the rolling condition determination section 215*d* changes a part of the rolling conditions (for example, manipulated variable of shape control actuator) of the steel sheet S being a roll target read in the processing of step S13, and proceeds to the processing of step S17. In the processing of step S17, the result output section 215*e* transmits the changed information regarding a part of the rolling conditions to the rolling control device 100 via the output device 240.

When a part of the rolling conditions has been changed in the processing of step S16, the rolling condition determination section 215*d* determines, in the processing of step S17, the rolling conditions of the steel sheet S being a roll target, in which a part of the rolling conditions, specifically, manipulated variable of bender amount or shift amount in the work roll or the intermediate roll has been changed, as the optimized rolling condition of the steel sheet S. Subsequently, the rolling condition determination section 215*d* determines the manipulated variable of the shape control actuator based on the rolling condition at that time. The rolling control device 100 changes the rolling conditions based on information related to the shape control actuator transmitted from the result output section 215*e* in the cold rolling stage.

As a method of calculating the change amount of the rolling condition, the rolling condition determination section 215*d* calculates an appropriate rolling condition of the steel sheet S being a roll target based on a difference between the shape parameter obtained in the processing of step S14 and the shape constraint determination threshold read in the processing of step S12. The rolling condition determination section 215*d* then compares the calculated rolling condition with the rolling condition of the steel sheet S being a roll target read in the processing of step S13, and changes the rolling condition in the processing of step S17.

Returning to the processing of step S13, the rolling shape prediction section 215*c* reads the rolling conditions of the steel sheet S being a roll target in which a part of the rolling conditions has been changed. In addition, in the processing of step S14, by using the neural network model as the shape control prediction model, the rolling shape prediction section 215*c* obtains a shape parameter of the steel sheet S undergoing cold rolling corresponding to the rolling condition of the steel sheet S being a roll target, a part of which has been changed, read in the processing of step S13. In the processing of step S15, the rolling condition determination section 215*d* determines whether the shape parameter obtained in the processing of step S14 is within the shape constraint determination threshold read in the processing of step S12. Thereafter, a series of processing of step S13, step S14, step S15, step S16, and step S17 is repeatedly executed until the determination result indicates YES. This ends the processing (shape control determination step) performed by the prediction model execution section 215.

As is clear from the above description, the present embodiment uses a configuration in which the prediction model generation section 214 generates a shape control prediction model by a machine learning method that links past rolling performance of the steel sheet S and past shape control performance corresponding to the past rolling performance to each other. In addition, the prediction model execution section 215 obtains the shape parameter of the steel sheet S as a roll target by the generated shape control prediction model during the cold rolling of the steel sheet S. The prediction model execution section 215 then determines the rolling condition of the steel sheet S being a roll target so as to set the obtained shape parameter to a value within the shape constraint determination threshold. This makes it possible to implement shape control satisfying various constraints in the rolling operation independent of operator's experience and subjectivity, making it possible to maintain productivity while preventing troubles such as shape defects and breakage during cold rolling. Furthermore, according to the present embodiment, the numerical information collected from the rolling performance data is joined and the multi-dimensional array information is used as the input data as the explanatory variable used for the shape prediction of the steel sheet S during the cold rolling, making it possible to identify, on the neural network model, the factor highly contributing to the constraint occurring during the cold rolling.

[Modifications]

Although the embodiments of the present invention have been described above, the present invention is not limited thereto, and various modifications and improvements can be made. For example, in the present embodiment, the repetition of the shape prediction of the steel sheet S by the shape control prediction model and the determination of rolling conditions are performed over the entire length of the coil, but may be performed over a part of the coil. The cold rolling mill 1 is not limited to the four-stage rolling mill, but may be a multi-stage rolling mill such as a two-stage (2Hi) rolling mill or a six-stage (6Hi) rolling mill, and the number of rolling stands is not particularly limited. Furthermore, the rolling mill may be a cluster rolling mill or a Sendzimir rolling mill.

In addition, when the arithmetic unit 200 calculates an abnormal controlled variable exceeding the change upper and lower limit values of the shape control actuator or cannot calculate the controlled variable, the rolling control device 100 cannot execute control based on the command from the arithmetic unit 200. Therefore, it is preferable that the rolling control device 100 is not to perform the present implementation when the controlled variable from the arithmetic unit 200 is determined to be abnormal, when the controlled variable is not supplied from the arithmetic unit 200, or the like.

In addition, although the output device 240 and the operation monitoring device 400 are not connected in the configuration example illustrated in FIG. 2, the devices may be communicably connected to each other. With this configuration, the processing result of the prediction model execution section 215 (in particular, the shape prediction information of the steel sheet S being rolled by the rolling shape prediction section 215*c* and the changed rolling conditions determined by the rolling condition determination section 215*d*) can be displayed on the operation screen of the operation monitoring device 400.

Implementation Example

Hereinafter, the present invention will be described based on an implementation example.

Using a tandem cold rolling mill including all five rolling stands according to the embodiment illustrated in FIG. 1, an experiment was conducted in which a raw steel sheet for an electromagnetic steel sheet containing 2.5 mass % Si with a base material thickness of 2.0 mm and a sheet width of 1000 mm was rolled with cold rolling into a roll material with a finished thickness of 0.300 mm. Stock solution used for the rolling oil was a stock solution obtained by adding 1 mass % of an oil-based agent and 1 mass % of an antioxidant to a base oil obtained by adding vegetable oil to synthetic ester oil, with additional 3 mass %, as concentration with respect to the oil, of a nonionic surfactant as a surfactant to the base oil. The emulsion rolling oil to be used in circulation was prepared into an emulsion rolling oil having a rolling oil concentration of 3.5 mass %, an average particle diameter of 5 μm, and a temperature of 55° C. As preliminary training, a training using a neural network model was performed using training data (past rolling performance data of about 3000 steel sheets), and then, a neural network model to be used for prediction of a steel sheet shape was created by linking past rolling performance of the steel sheet and the past rolling performance of the steel sheet to each other.

The past rolling performance data of the steel sheet used in the invention example was information including deformation resistance of the steel sheet, the rolling pass schedule (rolling load, tension, steel sheet shape, sheet thickness accuracy), the emulsion property, the work roll dimension, crown, and roughness information, the bender amount, and the work roll shift amount, in addition to longitudinal steel sheet information performance in the width direction of the steel sheet measured on the rolling entry side. In addition, multi-dimensional array information obtained by duplicating and joining the rolling performance data was used as the input performance data. As past rolling performance data of the steel sheet, the rolling delivery-side steel sheet shape performance was learned. The roll gap was adjusted by a tandem cold rolling mill, and the shape of the steel sheet after cold rolling was predicted by the generated neural network model at the stage when the rolling control device 100 turned on after passage through the welding point of the steel sheet. Subsequently, the rolling conditions were appropriately changed so that the predicted shape was set to a value within a predetermined shape constraint determination threshold, thereby setting the rolling conditions.

Also in a comparative example, similarly to the invention example, an experiment was conducted in which a raw steel sheet (roll target) for an electromagnetic steel sheet containing 2.8 mass % Si with a base material thickness of 1.8 mm and a sheet width of 1000 mm was rolled with cold rolling to a sheet thickness of 0.3 mm. In the comparative examples with numbers 1, 3, 5, 7, 9, and 11, a neural network model used for steel sheet shape prediction was generated by linking the past steel sheet shape performance data pieces using the input data in which the past rolling performance data pieces of the steel sheet were arranged in a one-dimensional array without being duplicated in the time direction.

The number of breakage occurrences of the steel sheets after 100 coil rolling in the invention example and the comparative example is indicated in Table 1. As indicated in Table 1, sufficient learning was not performed in the comparative example, and thus, a great fluctuation in the entry-side sheet crown caused an occurrence of trouble such as area reduction or breakage beyond operational constraints.

From the above, it has been confirmed that it is preferable to use the cold rolling method and the cold rolling mill according to the present invention to appropriately predict the shape of the steel sheet during the rolling and determine the steel sheet shape after the rolling by appropriately changing the rolling conditions so that the predicted shape parameter falls within the preset shape constraint determination threshold. In addition, it has been confirmed that, by application of the present invention, it is not only possible to suppress occurrence of troubles such as shape defects and sheet breakage during cold rolling, but also to greatly contribute to improvement in productivity and quality in a rolling step and subsequent steps.

TABLE 1

| No. | Amount of Si (mass %) | Finished sheet thickness (mm) | Rolling entry-side steel sheet information | Dimensionality of explanatory variable | Occurrence of breakage (number of occurrence in 100 coils) | |
|---|---|---|---|---|---|---|
| 1 | 2.5 | 0.30 | Sheet thickness | One-dimensional | 8 | Comparative example |
| 2 | 2.5 | 0.30 | Sheet thickness | Two-dimensional | 0 | Invention example |
| 3 | 2.5 | 0.25 | Sheet thickness | One-dimensional | 13 | Comparative example |
| 4 | 2.5 | 0.25 | Sheet thickness | Two-dimensional | 0 | Invention example |
| 5 | 3.0 | 0.30 | Sheet thickness | One-dimensional | 15 | Comparative example |
| 6 | 3.0 | 0.30 | Sheet thickness | Two-dimensional | 0 | Invention example |
| 7 | 2.5 | 0.30 | Temperature | One-dimensional | 9 | Comparative example |
| 8 | 2.5 | 0.30 | Temperature | Two-dimensional | 0 | Invention example |
| 9 | 2.5 | 0.25 | Temperature | One-dimensional | 14 | Comparative example |
| 10 | 2.5 | 0.25 | Temperature | Two-dimensional | 0 | Invention example |
| 11 | 3.0 | 0.30 | Temperature | One-dimensional | 12 | Comparative example |
| 12 | 3.0 | 0.30 | Temperature | Two-dimensional | 0 | Invention example |

The above has described the embodiments as application of the invention made by the present inventors, in which the present invention is not limited by the description and drawings constituting a part of the disclosure of the present invention according to the present embodiments. That is, other embodiments, implementation examples, operational techniques, and the like made by those skilled in the art based on the present embodiment are all included in the scope of the present invention.

INDUSTRIAL APPLICABILITY

According to of the present invention, it is possible to provide a cold rolling mill rolling condition setting method and a cold rolling mill rolling condition setting device capable of setting rolling conditions of performing cold rolling with high productivity while ensuring stability of cold rolling even when rolling a difficult-to-roll material with a high load and a small pre-rolling sheet thickness. In addition, according to the present invention, it is possible to provide a cold rolling method and a cold rolling mill capable of performing cold rolling with high productivity while ensuring stability of cold rolling even when performing cold rolling of a difficult-to-roll material with a high load and a small pre-rolling sheet thickness. Further, according to the present invention, it is possible to provide a steel sheet manufacturing method capable of manufacturing a steel sheet with high yield.

REFERENCE SIGNS LIST

1 COLD ROLLING MILL
2 DIRTY OIL TANK (RECOVERY TANK)
3 CLEAN OIL TANK
5 OIL PAN
6 RETURN PIPE
7 STIRRER
8 IRON POWDER REMOVER
9 PUMP
11 SUPPLY LINE
12 LUBRICATING COOLANT HEADER
13 COOLING COOLANT HEADER
100 ROLLING CONTROL DEVICE
200 ARITHMETIC UNIT
210 ARITHMETIC DEVICE
211 RANDOM ACCESS MEMORY (RAM)
212 READ ONLY MEMORY (ROM)
**212*a*** PREDICTION MODEL GENERATION PROGRAM
**212*b*** PREDICTION MODEL EXECUTION PROGRAM
213 ARITHMETIC PROCESSING SECTION
214 PREDICTION MODEL GENERATION SECTION
**214*a*** TRAINING DATA ACQUISITION SECTION

214*b* PREPROCESSING SECTION
214*c* FIRST DATA TRANSFORMER
214*d* MODEL GENERATION SECTION
214*e* RESULT STORAGE SECTION
215 PREDICTION MODEL EXECUTION SECTION
215*a* INFORMATION READING SECTION
215*b* SECOND DATA TRANSFORMER
215*c* ROLLING SHAPE PREDICTION SECTION
215*d* ROLLING CONDITION DETERMINATION SECTION
215*e* RESULT OUTPUT SECTION
220 INPUT DEVICE
230 STORAGE DEVICE
240 OUTPUT DEVICE
300 STEEL SHEET INFORMATION MEASUREMENT DEVICE
400 OPERATION MONITORING DEVICE
501 INPUT LAYER
502 INTERMEDIATE LAYER
503 OUTPUT LAYER
S STEEL SHEET

The invention claimed is:

1. A cold rolling mill rolling condition setting method, which is a method of setting a target rolling condition of a cold rolling mill when a roll target material is rolled by cold rolling using a prediction model that predicts a post-cold rolling state of the roll target material, the prediction model being generated with an explanatory variable and an objective variable, the explanatory variable being first multi-dimensional data obtained by joining past rolling performance data including pre-cold rolling data of a roll material on an entry side of the cold rolling mill in a time direction, and the objective variable being post-cold rolling data of the roll material on a delivery side of the cold rolling mill, the method comprising:

estimating a post-rolling shape of the roll target material on the delivery side of the cold rolling mill by inputting, to the prediction model, second multi-dimensional data generated from information including the pre-cold rolling data of the roll target material on the entry side of the cold rolling mill and a target rolling condition of the cold rolling mill; and changing the target rolling condition of the cold rolling mill such that the estimated post-rolling shape of the roll target material satisfies a predetermined condition.

2. The cold rolling mill rolling condition setting method according to claim 1, wherein the pre-cold rolling data includes at least one of thickness information of the steel sheet and temperature information of the steel sheet, on the entry side of the cold rolling mill.

3. The cold rolling mill rolling condition setting method according to claim 1, wherein the post-cold rolling data includes shape parameters calculated from the shape of the steel sheet on the delivery side of the cold rolling mill.

4. The cold rolling mill rolling condition setting method according to claim 2, wherein the post-cold rolling data includes shape parameters calculated from the shape of the steel sheet on the delivery side of the cold rolling mill.

5. A cold rolling method comprising performing a cold rolling of a roll target material using a target rolling condition of the cold rolling mill changed using the cold rolling mill rolling condition setting method according to claim 1.

6. A steel sheet manufacturing method comprising manufacturing a steel sheet using the cold rolling method according to claim 5.

7. A cold rolling mill rolling condition setting device, which is a device of setting a target rolling condition of a cold rolling mill when a roll target material is rolled by cold rolling using a prediction model that predicts a post-cold rolling state of the roll target material, the prediction model being generated with an explanatory variable and an objective variable, the explanatory variable being first multi-dimensional data obtained by joining past rolling performance data including pre-cold rolling data of a roll material on an entry side of the cold rolling mill in a time direction, and the objective variable being post-cold rolling data of the roll material on a delivery side of the cold rolling mill, the device comprising a processor comprising hardware, the processor being configured to:

estimate a post-rolling shape of the roll target material on the delivery side of the cold rolling mill by inputting, to the prediction model, second multi-dimensional data generated from information including the pre-cold rolling data of the roll target material on the entry side of the cold rolling mill and a target rolling condition of the cold rolling mill; and change the target rolling condition of the cold rolling mill such that the estimated post-rolling shape of the roll target material satisfies a predetermined condition.

8. The cold rolling mill rolling condition setting device according to claim 7, wherein the pre-cold rolling data includes at least one of thickness information of the steel sheet and temperature information of the steel sheet, on the entry side of the cold rolling mill.

9. The cold rolling mill rolling condition setting device according to claim 7, wherein the post-cold rolling data includes shape parameters calculated from the shape of the steel sheet on the delivery side of the cold rolling mill.

10. The cold rolling mill rolling condition setting device according to claim 8, wherein the post-cold rolling data includes shape parameters calculated from the shape of the steel sheet on the delivery side of the cold rolling mill.

11. A cold rolling mill comprising the cold rolling mill rolling condition setting device according to claim 7.

* * * * *